US005299333A

United States Patent [19]

Pedersen et al.

[11] Patent Number: 5,299,333

[45] Date of Patent: Apr. 5, 1994

[54] RANDOM FLOW DOWN COMFORTER WITH A RESTRICTED BORDER REGION

[76] Inventors: Samuel B. Pedersen, 1117 17th Ave. E., Seattle, Wash. 98112; Nicolas J. Hanauer, 108 Lake Dell Ave., Seattle, Wash. 98122

[21] Appl. No.: 959,080

[22] Filed: Oct. 9, 1992

[51] Int. Cl.[5] ..... A47G 9/02
[52] U.S. Cl. ..... 5/502; 5/486
[58] Field of Search ..... 5/502, 500, 486, 482; D6/603

[56] References Cited

U.S. PATENT DOCUMENTS

| | | | |
|---|---|---|---|
| 2,348,807 | 5/1944 | Goodstein | 5/502 |
| 2,544,797 | 3/1951 | Lippmann | 5/502 |
| 4,748,703 | 6/1988 | Emi et al. | 5/502 |
| 5,199,121 | 4/1993 | Payne | 5/502 |

FOREIGN PATENT DOCUMENTS

| | | | |
|---|---|---|---|
| 2599610 | 12/1987 | France | 5/502 |

OTHER PUBLICATIONS

"Down Lite International" 106 Northeast Drive, Loveland, Ohio, 05140; Portion of 1987 and 1992 Catalogs.

*Primary Examiner*—Alexander Grosz
*Attorney, Agent, or Firm*—Jensen & Puntigam

[57] ABSTRACT

A down comforter includes a center region (22) and a border region (24) which extends around the comforter and defines the peripheral edge of the comforter. Typically, the center region (24) is approximately 53 to 62 percent of the total area of the comforter. The border region (24) is continuous and has the same width around the periphery of the comforter. A pillow includes upper and lower casing members (40, 42) between which are located upper and lower baffle members (44, 46). The baffle members 44, 46 are stitched together along two longitudinal lines of stitching (48, 50). The casing members (40, 42) and the baffle members (44, 46), all in registry, are stitched together along their respective longitudinal and end edges. The pillow is filled between the upper baffle member and the upper casing member and between the lower baffle member and the lower casing member, as well as between the two baffle members between the two lines of stitching.

4 Claims, 3 Drawing Sheets

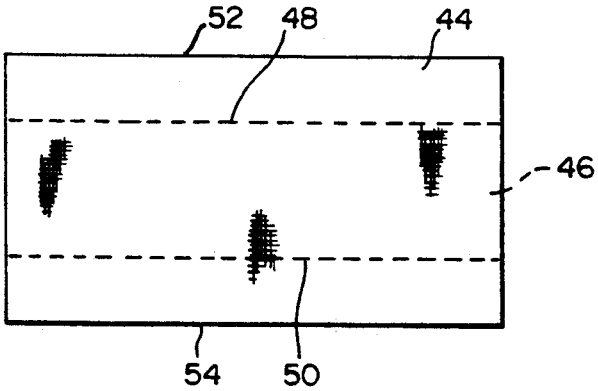
FIG. 7
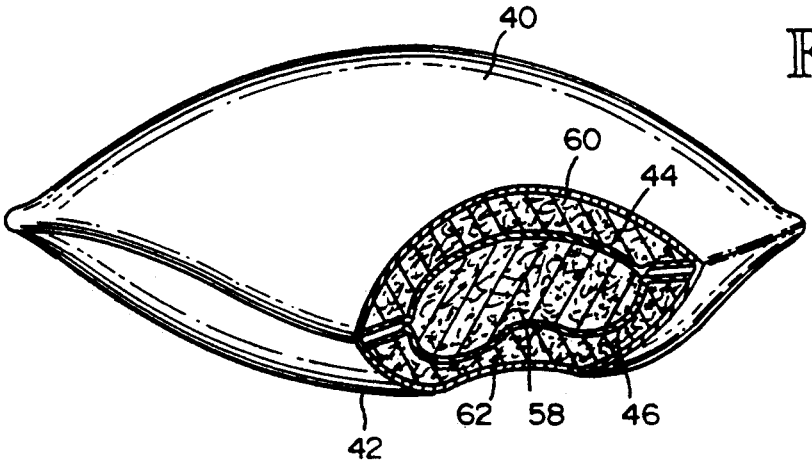
FIG. 8
FIG. 9
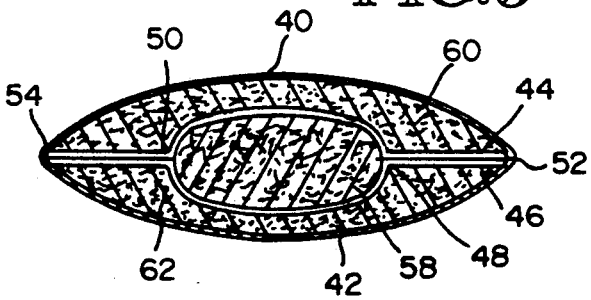
FIG. 10
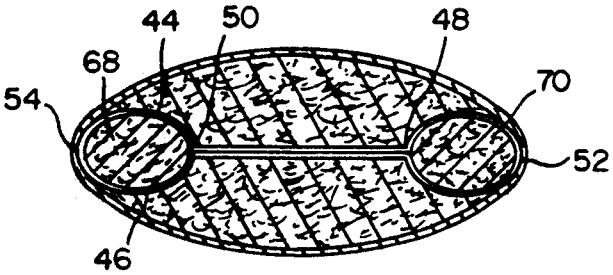

RANDOM FLOW DOWN COMFORTER WITH A RESTRICTED BORDER REGION

TECHNICAL FIELD

This invention relates generally to down comforters and more specifically concerns a particular construction for comforters. In addition, a particular construction for pillows is disclosed herein.

BACKGROUND OF THE INVENTION

Down comforters are well known in the United States and many other countries, including Europe, where the product originated. This lightweight, warm, natural bedding is desirable because of its fluffy, lofty appearance and significant durability.

Down comforters are manufactured with two basic sewing construction concepts, which each promote the comforter's aesthetic appeal and enhance its functionality in somewhat different ways. The two sewing constructions, referred to as controlled flow and random flow, control the distribution of the down and determine the loft of the down differently.

Controlled flow construction maintains an even distribution of down with a closed sewing pattern that restricts the movement of the down to relatively small areas within the body of the comforter. The most common configuration used is a consistent square box pattern. The size of the box usually varies between 6" and 20", with larger and smaller sizes possible. Many other closed sewing patterns have been used, such as tubes or channels, chevron scrolls, etc. In each case, the pattern defines an area where the down is uniformly distributed within the body of the comforter. Controlled flow construction produces an even distribution of down, but with only one, fixed, comfort level. It is not adjustable.

Random flow construction uses an open sewing pattern within the body of the comforter such that the down can flow to the edges, from top to bottom and side to side. This construction provides the maximum area for the down to loft to its thermal potential. It also provides the consumer the opportunity to adjust the down to his or her optimum comfort level. Different bedroom temperatures, consumer metabolism, and changing weather conditions are factors that determine varying comfort levels and the need to move or adjust the down within the body of the comforter. The available area within the comforter for the down to loft, furthermore, is maximized. Some examples of random flow sewing configurations are karo or line stitch (normally in a square pattern) ringstitch and diamond-shaped patterns. Many other variations and designs are possible which produce a variety in aesthetic appeal besides providing the important feature of adjustability that controlled flow constructions cannot provide.

Most sewing patterns in use today, whether controlled or random flow, use sewn-through stitches where the top and bottom fabric sections (forming the comforter envelope, which is known as the tick, are joined directly by the thread from the sewing machine. This sewing action within the body of the comforter creates what are known as "cold spots" because where the fabric is sewn together there is no down. The more sewing in the body of the comforter, the more cold spots. A piece of fabric known as a baffle (normally less than 1" in height) is sewn between the top and bottom fabrics. The down then lofts on either side of the baffle. Baffle sewing is an alternative to random flow construction because the baffles increase the available area for the down to loft and thereby maximize the comfort range, besides eliminating cold spots. The cost of labor for sewing baffle ticks, however, is quite high and additional down is required to fill the area created by the baffle. These additional costs effectively prohibit the use of baffles in controlled flow comforters.

Conventional random flow comforters are typically sized to hang down and cover the sides of the mattress as part of their aesthetic appeal. Through constant use and the force of gravity, however, the down will migrate from the center portion of the comforter and gather at the sides or the bottom. This migration of the down soon degrades the appearance and function of the comforter and compromises its intended adjustability. Thus, conventional random flow comforters require frequent re-fluffing to maintain effective distribution of the down. This task is time-consuming and can be difficult, particularly with luxury-sized comforters containing large amounts of down.

To some extent a similar problem exists for down (and feather) pillows, in which the down is pushed to one portion of the pillow, which typically occurs during actual use of the pillow, i.e. when the user is sleeping. This degrades the appearance and function of the pillow. Again, the typical remedy is redistribution of the down by fluffing, although this cannot be done, of course, when the user is sleeping. Discomfort in use results to a varying degree when the down is unevenly distributed in the pillow.

DISCLOSURE OF THE INVENTION

Accordingly, the present invention includes a random flow down comforter which includes: a center region and a border region, wherein the border region extends around a substantial portion of the center region; and means which separate the border region from the center region to prevent movement of down between the center region and the border region.

Another aspect herein is a pillow which includes: upper and lower casing members, each having longitudinal and end edges; upper and lower baffle members which are positioned interiorly of the upper and lower casing members, each baffle member having longitudinal and end edges, wherein the longitudinal and end edges, respectively, of the upper and lower casing members and the upper and lower baffle members are secured together to define upper and lower volumes between the upper baffle member and the upper casing member and between the lower baffle member and the lower casing member and wherein the upper and lower baffle members are secured together to form at least one interior volume; and pillow filling material positioned in the one interior volume and the upper and lower volumes.

BRIEF DESCRIPTION OF THE DRAWINGS

FIG. 7 is a plan view of the baffle portion of the pillow of the present invention.

FIG. 8 is a perspective view of the pillow of the present invention, partially cutaway.

FIG. 9 is a cross-section view of the pillow of FIG. 8.

FIG. 10 is a cross-section view of an alternative configuration to the pillow of FIG. 8.

BEST MODE FOR CARRYING OUT THE INVENTION

Figure 1:
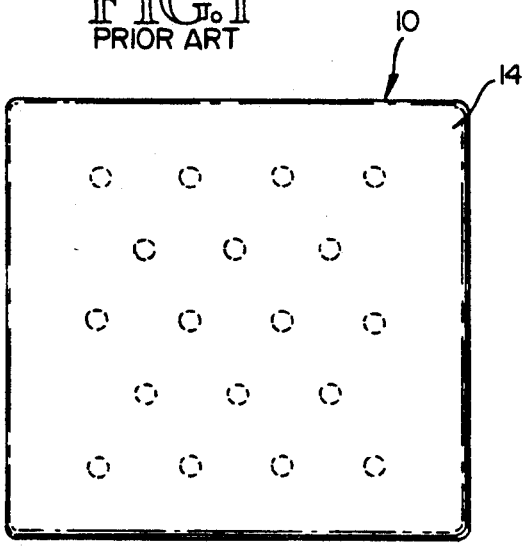
FIG. 1 PRIOR ART
FIG. 1 is a plan view of a conventional random flow down comforter.
Figure 1A:
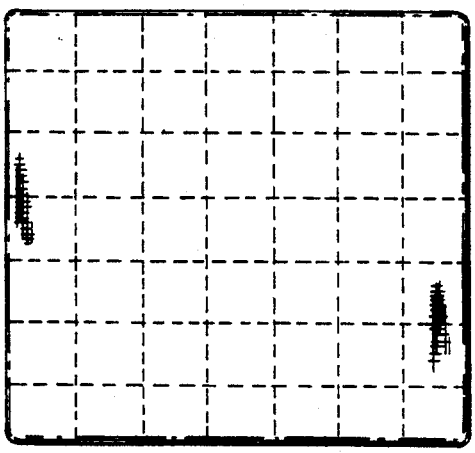
FIG. 1A is a plan view of a conventional controlled flow comforter.
Figure 3:
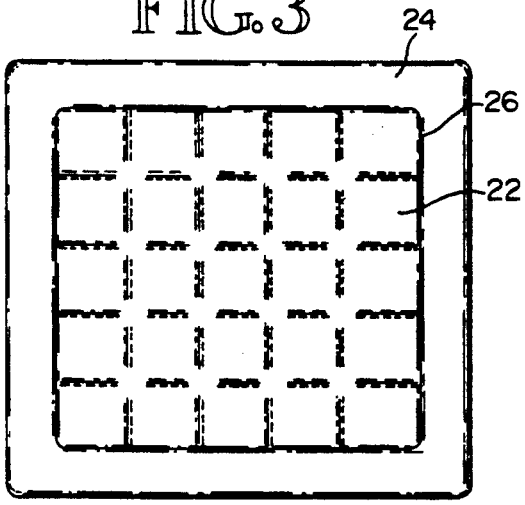
FIGS. 3–5 are plan views of variations of the random flow comforter of FIG. 2, with various sewing patterns in the center area of the comforter.
Figure 4:
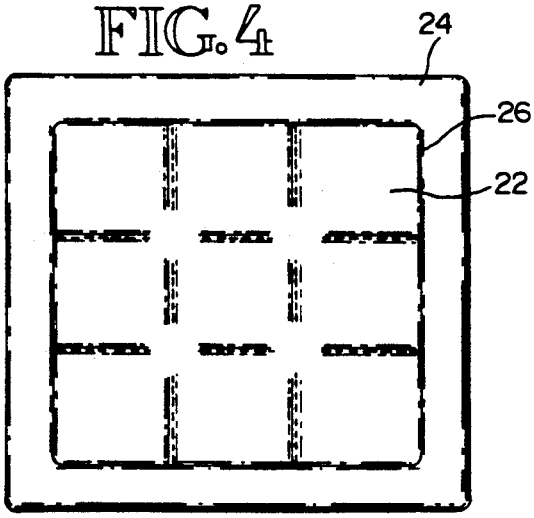
Figure 5:
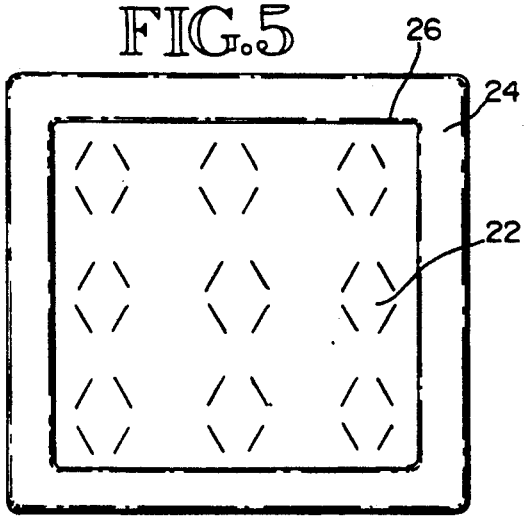
Figure 6:
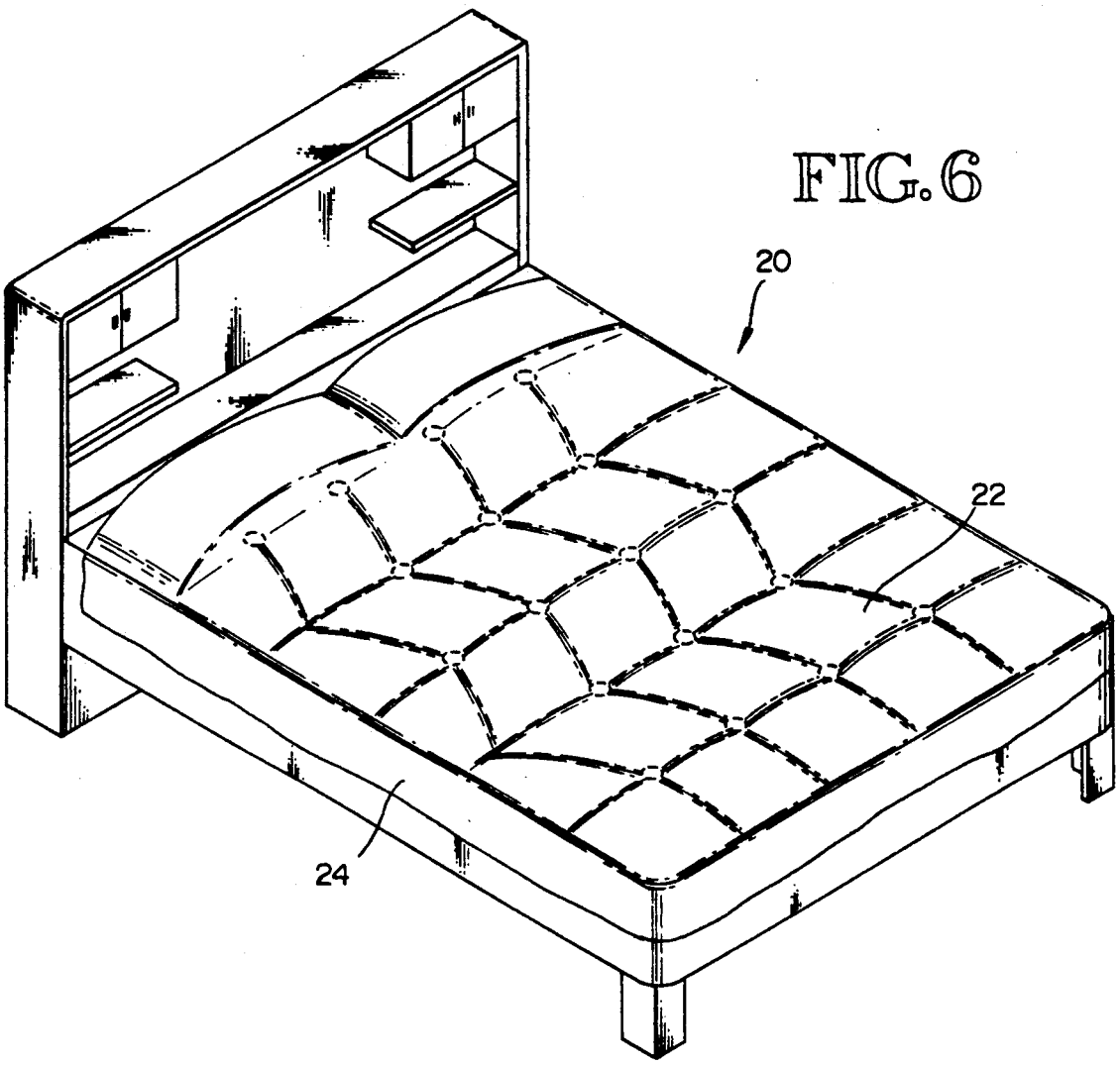
FIG. 6 is a perspective view of the comforter of the present invention in place on a conventional full size bed.

The conventional random flow comforter of FIG. 1, referred to generally at 10, is constructed with a certain sewing pattern referred to in the art as a ringstitch pattern. This stitch secures the upper and lower portions of the comforter casing 14 together. The ringstitching provides some control on the flow of down within the comforter; without the ringstitching, or some other sewing pattern, the entire comforter would be subject to completely unrestricted migration of down therein. The pattern of FIGS. 1 and 2 as well as the patterns of FIGS. 3–5 are random flow patterns. The present invention is not applicable to controlled flow comforters, such as shown in FIG. 1A, in which the down is fixed in position by relatively small closed areas of stitching.

With a random flow comforter, such as shown in FIG. 1, the down within casing 14 will readily migrate to the edges of the comforter, both when the comforter is in actual use and otherwise, which decreases significantly the aesthetic appeal of the comforter as well as the functional effectiveness of the comforter in maintaining consistent, even user warmth. Ease of adjustability is also impaired by concentration of the down at the edges. Frequent fluffing of the comforter is necessary to maintain the desired relatively even distribution of the down throughout the casing 14. This is inconvenient and often difficult, depending on the size of the comforter.

One particular comforter configuration (approximately square) is illustrated in FIG. 1; however it should be understood that comforters do come in various configurations and sizes. Comforters are also usually somewhat larger than the mattress with which they are used. For instance, a comforter having dimensions of 64 inches by 86 inches is typically used with a twin size mattress of 39 inches by 75 inches; a comforter of 80 inches by 86 inches is used with a full size mattress of 54 inches by 75 inches, a comforter of 86 inches by 86 inches (approximately square) is used with a queen size mattress of 60 inches by 80 inches, while a comforter of 101 inches by 86 inches is typically used with a king size mattress of 76 inches by 80 inches. Other sizes of comforters are certainly possible.

In the above size examples, the comforter is between 6 and 11 inches longer than the mattress and 25 to 26 inches wider than the mattress. Other size differences are possible.

Figure 2:
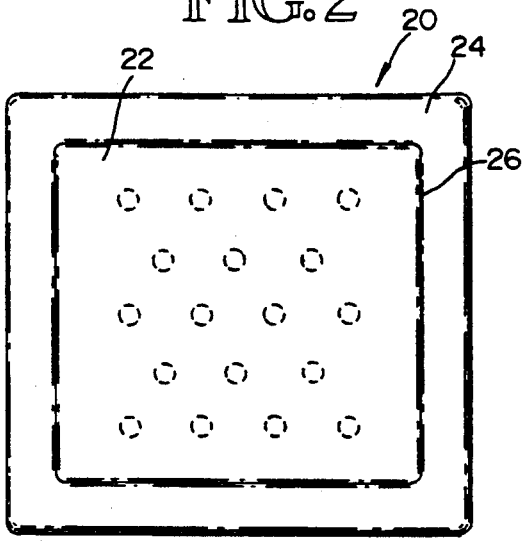
FIG. 2 shows a random flow comforter using the construction of the present invention.

Referring to FIG. 2, a basic comforter (with ringstitch) which incorporates the present invention is shown. The comforter of FIG. 2, shown generally at 20, includes a center area 22, which is bounded around the periphery thereof by a border area 24. The border area 24 is separated from the center area 22 by a continuous line of stitching 26 around comforter 20. In the embodiment shown, border area 24 is 10 inches wide and extends around the entire comforter. Border area 24 remains the same width regardless of the overall size of the comforter. This results in a comforter having a center area which is typically approximately 6 inches wider than the mattress with which it is typically used. The stitching line 26 will thus be 3 inches down the side of the mattress from the top edge thereof, thereby preventing any "cold line" effect due to the lack of down along stitching line 26.

In the embodiment shown, center area 22 of a twin size comforter is 44 by 66, while for a full or queen size comforter, the center area is 66 by 66 inches and for a king size comforter, the center area is 81 by 66 inches. Again, these sizes are representative only and may be varied. This results in the center area 22 being within the range of approximately 53 to 62 percent of the total area of the comforter, while the border area 24 is the remainder.

An advantage of the border arrangement of the present invention is that the border area 24 may be filled with less down than the rest of the comforter without sacrificing any of the function or aesthetics of the comforter, resulting in either a savings of down for the comforter, or alternatively, placement of the down which is saved in the center area, which gives the comforter a better, fuller appearance without any increase in the normal total down fill.

If the fill in the center area is not increased, the savings of down for a given comforter will typically be fairly substantial, usually ranging from 2 to 6 ounces, depending upon the size of the comforter as well as the particular sewing pattern used in the center area.

FIGS. 3 through 5 show a variety of other sewing patterns, including karotack, Euro baffle and diamond baffle patterns, respectively. These particular stitch patterns are all well known; additional patterns can be used. The sewing patterns are used to help maintain a relatively even distribution of down within center area 22 and to provide a variety of aesthetic "looks".

In addition to the possible savings on the total amount of down used in the comforter, in the event that the center area 22 will not receive the down saved from the border area, savings in the manufacture of the comforter is expected since the sewing pattern is confined to the center area 22. As indicated above, the center area is approximately 53 to 62 percent of the total area of the comforter; this reduction in the area to be stitched results in a substantial labor savings, even taking into account the additional labor required to do the border stitch line 26. The labor savings will vary depending upon the complexity of the stitch pattern. For instance, the diamond pattern is substantially more labor intensive than either the ringstitch or the karotack patterns.

Figure 2A:
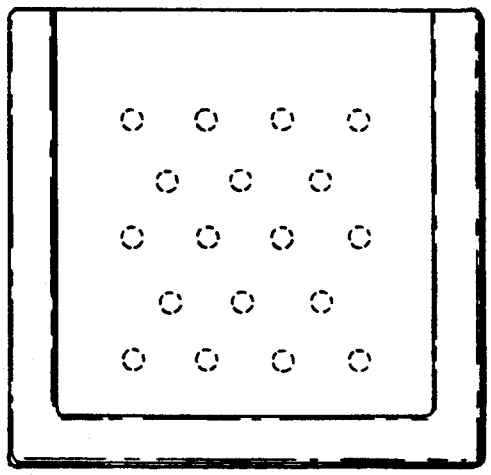
FIG. 2A shows a preferred embodiment of the comforter of the present invention having a border along the sides and the bottom thereof.

The border area 24 may have various configurations. Typically, the border area 24 for the sides of the comforter (which match with the sides of the bed) will be such that the center area 22 of the comforter is at least as wide, and typically slightly wider than, the width of the mattress on which the comforter is used. The border could change in dimension around the periphery of the comforter. For instance, the borders at the top edge and bottom edge could be a different width (typically less) than the side edge border portions, or still further, there could be no top and/or bottom border portions at all, or they could be different from each other and/or the side portions. Typically, the two side border portions will be the same width. FIG. 2A shows an embodiment of the comforter of the present invention having a border along the sides and the bottom thereof.

While the border shown is continuous, it could be partitioned into sections, such as by a stitching line at each corner of the comforter, or other locations along the length of the border. Also, the line of stitching 26, while generally straight in the embodiment shown, could be slightly curved or have other configurations. The important feature of the present invention is preventing the migration of down to the edges of the random flow comforter, particularly when the comforter is in use. Also, the comforter of the present invention, by virtue of the border area and the reduction of down in that area, is much easier to fluff, and typically easier to handle.

FIGS. 7 through 10 show the pillow of the present invention. A pillow is conventionally made with two substantially identical rectangular pieces of ticking, which are initially partially sewn together around a substantial portion (three sides) of their respective peripheries, the pillow filling then inserted, and the remaining peripheral portion sewn to complete the pillow. When the filling or stuffing is of down or feathers, however, such a pillow may become uncomfortable in use, when the filling is pushed to the edges of the pillow by the head of the user.

The pillow of the present invention includes two internal baffle pieces 44 and 46 in addition to the two conventional ticking pieces. Baffle pieces 44 and 46 are initially positioned in registry and then sewn together longitudinally. In the embodiment shown, there are two stitch lines 48 and 50, the two stitch lines being approximately 5 inches inboard from the longitudinal edges 52, 54 of the baffle pieces. This leaves a space of approximately 10 inches between stitch lines 48 and 50, assuming a 20 inch wide pillow. A wider pillow will result in increased space.

After the two baffle pieces are sewn as described above, they are placed between the two pieces of ticking described above. The four cloth pieces, all the same size and configuration, are then sewn along the longitudinal edges thereof and along one end, leaving the other end open, defining a total of five separate chambers within the pillow between the two ticking pieces.

At this point, a first "blow" of pillow filling, either feathers or down, is directed into the volume 58 defined between the two lines of stitching 48 and 50 connecting the two baffle pieces 44, 46, as shown most clearly in FIGS. 8 and 9. The filling will typically vary between 5 ounces and 15 ounces in weight. There then follows second and third "blows", in which the volumes 60 and 62 between the upper baffle piece 44 and upper ticking 40 and the lower baffle piece 46 and lower ticking piece 42, respectively, are filled with down or feathers.

The weight of the down in volumes 60 and 62 will also vary between 5 ounces and 15 ounces. However, volume 58 will typically be filled with a greater weight per unit volume than volumes 60, 62 so that there results a "firmer" portion of the pillow in the center of the pillow. The filling in volume 58 will not migrate to the edges of the complete pillow, because of the fixed boundaries of volume 58 within the pillow.

Alternatively, the fixed inner volume which is filled by the first blow could be one or both of volumes 68, 70 defined between the upper and lower baffle pieces 44, 46; in one case between stitching line 48 and the adjacent sewn longitudinal edge 52 and in the other case between stitching line 50 and the adjacent sewn longitudinal edge 54 of the pillow. In addition, all three internal volumes 58, 68 and 70 could be filled, or a combination of the center volume 58 and one of the side volumes 68, 70.

In each case, however, the internal volumes are typically filled with a greater weight per unit volume of filling than the other volumes, although in a particular embodiment, the internal volumes could possibly have an approximately equal or in some cases, even lower weight per unit volume of filling than the other volumes. In addition, while the internal volumes will typically be filled with down/feathers, they could conveniently be filled with foam or other material.

Hence, a random flow comforter has been described which eliminates the migration of down in the comforter to the edges of the comforter. It accomplishes this by a border area for the comforter. Also a pillow has been described having a particular construction which reduces migration of down within the pillow during use.

Although a preferred embodiment of the invention has been disclosed herein for illustration, it should be understood that various changes, modifications and substitutions may be incorporated in such embodiment without departing from the spirit of the invention which is defined by the claims that follow:

What is claimed is:

1. A random flow down comforter for use with a mattress having side and end edges, comprising:

a random flow down comforter body having a center region with two side edges and foot and head end edges and an edge border region, wherein the border region extends around the two side edges and the foot end edge, but not the head end edge, of the center region, wherein the border region is continuous, approximately on the order of ten inches wide, and contains less down per unit volume than the center region; and means separating the border region from the center region for preventing movement of down between the center region and the border region, wherein the separating means along the respective side edges of the comforter body is located approximately on the order of three inches outboard from the side edges of the mattress when the comforter is positioned thereon.

2. An article of claim 1, wherein the preventing means is a line of stitching.

3. An article of claim 1, wherein the border region has a width which is approximately the same around the comforter.

4. An apparatus of claim 1, wherein the center region includes a stitch pattern for controlling migration of down within the center region.

* * * * *

US005299333B1

REEXAMINATION CERTIFICATE (3178th)

United States Patent [19] [11] B1 5,299,333

Pedersen et al. [45] Certificate Issued Apr. 22, 1997

[54] RANDOM FLOW DOWN COMFORTER WITH A RESTRICTED BORDER REGION

[76] Inventors: Samuel B. Pedersen, 1117 17th Ave. E., Seattle, Wash. 98112; Nicholas J. Hanauer, 108 Lake Dell Ave., Seattle, Wash. 98122

Reexamination Request:
No. 90/004,177, Mar. 12, 1996

Reexamination Certificate for:

| | |
|---|---|
| Patent No.: | **5,299,333** |
| Issued: | **Apr. 5, 1994** |
| Appl. No.: | **959,080** |
| Filed: | **Oct. 9, 1992** |

[51] Int. Cl.[6] ..... A47G 9/02
[52] U.S. Cl. ..... 5/502; 5/486
[58] Field of Search ..... 5/502, 486, 500, 5/482; D6/603

[56] References Cited

U.S. PATENT DOCUMENTS 4,748,703 6/1988 Emi et al. ..... 5/502

FOREIGN PATENT DOCUMENTS 2599610 12/1987 France ..... 5/502

OTHER PUBLICATIONS

L.L. Bean, Inc., "Home and Camp Specialties", Fall 1991.
Eddie Bauer, Inc., "Give a Gift to the Earth This Season" 1990.
Down-Lite International, Catalog, May 1987.
Down-Lite International, Catalog, 1992.

*Primary Examiner*—Alexander Grosz

[57] ABSTRACT

A down comforter includes a center region (22) and a border region (24) which extends around the comforter and defines the peripheral edge of the comforter. Typically, the center region (24) is approximately 53 to 62 percent of the total area of the comforter. The border region (24) is continuous and has the same width around the periphery of the comforter. A pillow includes upper and lower casing members (40, 42) between which are located upper and lower baffle members (44, 46). The baffle members 44, 46 are stitched together along two longitudinal lines of stitching (48, 50). The casing members (40, 42) and the baffle members (44, 46), all in registry, are stitched together along their respective longitudinal and end edges. The pillow is filled between the upper baffle member and the upper casing member and between the lower baffle member and the lower casing member, as well as between the two baffle members between the two lines of stitching.

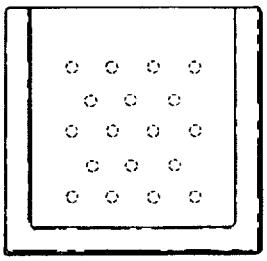

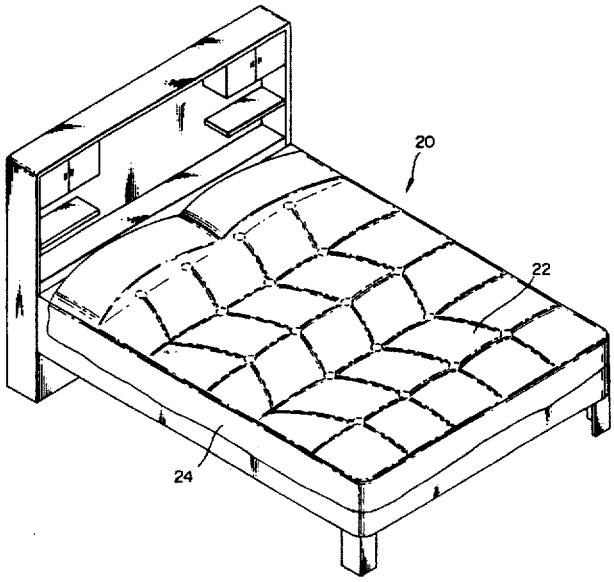

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–4 is confirmed.

* * * * *